US008646125B2

(12) United States Patent
Stryker et al.

(10) Patent No.: US 8,646,125 B2
(45) **Date of Patent: *Feb. 11, 2014**

(54) TRANSPORT APPARATUS

(75) Inventors: Martin W. Stryker, Kalamazoo, MI (US); Jeffrey L. Lewandowski, Delton, MI (US); Jason James Wroblewski, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/242,494

(22) Filed: Sep. 23, 2011

(65) Prior Publication Data

US 2012/0090089 A1 Apr. 19, 2012

Related U.S. Application Data

(60) Provisional application No. 61/394,525, filed on Oct. 19, 2010.

(51) Int. Cl.
*A61G 7/10* (2006.01)

(52) U.S. Cl.
USPC ..... 5/87.1; 5/86.1; 5/81.1 R; 5/83.1; 254/124

(58) Field of Classification Search
USPC ..... 5/81.1 R, 81.1 T, 83.1, 86.1, 87.1, 88.1, 5/620, 662
See application file for complete search history.

(56) References Cited

U.S. PATENT DOCUMENTS 2,681,455 A * 6/1954 Schwartz ..... 5/86.1
2,821,406 A * 1/1958 Hoyer et al. ..... 280/657
2,903,238 A * 9/1959 Flandrick ..... 254/124
3,222,029 A * 12/1965 Hildemann ..... 254/8 R
4,070,721 A 1/1978 Stasko
4,545,085 A * 10/1985 Feldt ..... 5/87.1
5,704,439 A * 1/1998 Kitahama et al. ..... 180/65.1
6,092,247 A * 7/2000 Wilson ..... 5/86.1
6,532,610 B1 * 3/2003 Calfas et al. ..... 5/626
8,381,332 B2 * 2/2013 Fakhrizadeh ..... 5/89.1

(Continued)

FOREIGN PATENT DOCUMENTS

JP 2001-346839 12/2001

OTHER PUBLICATIONS

PCT Search Report and Written Opinion dated Apr. 20, 2012 for corresponding PCT Application No. PCT/US2011/052972.

*Primary Examiner* — Robert G Santos
*Assistant Examiner* — Myles Throop
(74) *Attorney, Agent, or Firm* — Warner Norcross & Judd LLP

(57) ABSTRACT

A transport apparatus includes a base, a sling, a support frame mounted to the base. The support frame extends over the base and is configured to move from a first position spaced above the base at a first height wherein the support frame may be extended over and proximate a support surface for engaging the sling when placed on the support surface to a second position spaced above a second height greater than the first height once engaged with the sling wherein when the support frame and the sling are raised to the second position the sling is raised above the support surface so that a person supported on the sling may be lifted off the support surface with the sling and moved away from the support surface by the base. Further, the sling may be rotatably mounted to the support frame to facilitate reorientation of the person.

12 Claims, 14 Drawing Sheets

(56) References Cited

U.S. PATENT DOCUMENTS

2009/0249544 A1* 10/2009 Palay et al. ..... 5/83.1
2009/0307840 A1 12/2009 Lingegard
2010/0154115 A1* 6/2010 Wernqvist et al. ..... 5/86.1
2010/0224841 A1* 9/2010 Liljedahl ..... 254/120
2010/0287698 A1* 11/2010 Stryker ..... 5/87.1

* cited by examiner

TRANSPORT APPARATUS

CROSS-REFERENCE TO RELATED APPLICATIONS

This application claims priority to U.S. provisional application Ser. 61/394,525, filed Oct. 19, 2010, entitled TRANSPORT APPARATUS, which is incorporated by reference herein in its entirety. This application is also related to U.S. patent application Ser. No. 12/774,365, filed May 5, 2010, which claims the benefit of and priority from U.S. provisional patent application Ser. No. 61/177,809, filed May 13, 2009, entitled TRANSPORT APPARATUS, by Applicant Martin W. Stryker, which are incorporated by reference herein in their entireties.

TECHNICAL FIELD AND BACKGROUND OF THE INVENTION

The present invention generally relates to a transport apparatus for moving a person, such as a patient, from one location to another location, for example from a bed to a chair.

When a caregiver assists an immobile person move or transfer, for example, from a bed to a chair, whether the lack of mobility is due to illness or a disability, the caregiver is often exposed to strain and stress that could potentially harm the caregiver. In an effort to reduce the strain and stress on caregivers, numerous devices have been developed that reduce the force need to move the patient across the surface on which the person is supported and typically are designed to move a person when in a supine position. But most of these devices have fallen short of reducing the strain and stress when moving a person when they are to be moved from a supine position on one surface to a sitting position on another surface or moved from a sitting position on one surface to a sitting position or supine position on another surface.

SUMMARY OF THE INVENTION

Accordingly, the present invention provides a transport apparatus that allows a person to be moved from a supine position on one surface, such a bed, stretcher, cot or table, to a sitting position in the apparatus itself or on another surface, such as a chair, while reducing the stress or strain on the caregiver moving the person or vice versa. Further, the transport apparatus may enable an otherwise less mobile person to move themselves once they are in a sitting position.

In one form of the invention, a transport apparatus includes a base, a sling, and a lifting arm mounted to the base. The lifting arm extends from the base and is configured to move from a first height relative to the base, wherein the lifting arm may be extended over and proximate a patient support surface for engaging a sling placed on the patient support surface, to a second height greater than the first height after engagement with the sling. The sling is adapted to be reconfigured from a planar arrangement to non-planar, folded or cradle arrangement for suspending a person in seated position in the sling above the patient support surface when the lifting arm lifts the sling. In addition, the sling is rotatably mounted to the lifting arm. In this manner, a person supported in a supine position on the sling when it is in its planar arrangement may be raised to a sitting position and then lifted off the patient support surface so that the person can moved away from the support surface by the base. Additionally, the patient may then be reoriented to facilitate transferring the patient to another support surface.

In one aspect, the apparatus further includes a seat frame. The sling is adapted to be engaged by the seat frame when the sling moved over the seat frame. For example, the sling and seat frame may be adapted to engage each other when the sling is lowered to a third height, which is less than the second height.

In one aspect, the sling includes engagement surfaces that are engaged by the seat frame when the lift arm is moved to the third height. For example, the engagement surfaces may comprise receptacles, and the seat frame may include projecting structures that extend into the receptacles to thereby engage the sling. The receptacles may be, for example, pockets formed on the sides of the folded sling. The projecting structures may be formed by tubular members arranged in an inverted U-shape configuration, which extend upwardly from the seat frame.

In further aspects, the seat frame may be formed by a pair of deployable arms that are mounted for movement between a stowed position and a deployed position where they are engageable by the sling and optionally provide arm rests for the person supported on the sling.

According to yet other aspects, the sling is formed from a sheet of material, and is engaged by the lifting arm at a plurality of location around the perimeter of the sheet.

In another form of the invention, a transport apparatus includes a movable base, a sling, and a frame mounted to the base. The sling is reconfigurable between a generally planar configuration wherein the sling can lie generally flat on a support surface and a cradle configuration wherein a person can be supported in a sitting position in the sling. The frame is configured to move from a first position spaced above the base at a first height wherein the frame may be extended over and proximate a support surface to a second position spaced above the base at a second height greater than the first height. The frame is engageable with the sling so that the transport apparatus can support and transport a person supported by the sling from one location to another location. In addition, the sling is optionally releasably engaged with the frame wherein a person supported by the sling and the frame may be then deposited together with the sling on another support surface when the frame is extended over the other support surface. To facilitate transferring the patient to second support surface with a different configuration from the first support surface, the base width or height may be adjustable.

In one aspect, the apparatus may also include a driver, which is operable by a user or a person supported by the transport apparatus to move the apparatus across a ground surface.

In yet another aspect, the movable base includes two base frames coupled together to form two sides of the base, with the base frames being movable relative to each other to adjust the footprint of the base.

In addition, the transport apparatus may include an actuator for moving the base frames relative to each other. Further, the apparatus may include a handle that is operatively coupled to the actuator to allow manual adjustment of the actuator and the footprint.

According to yet another form of the invention, a transport apparatus includes a seat, a movable base for engaging a ground surface, and a driver supported at or adjacent the base for engaging the ground surface and selectively driving the base across the ground surface. The movable base includes a support frame configured to move from a first position spaced above the base at a first height wherein the support frame may be extended over and proximate a support surface for engaging the seat when placed on the support surface to a second position spaced above a second height greater than the first height, wherein when the support frame and the seat are raised to the second position above the support surface a person supported on the seat may be lifted off the support surface with the seat and moved away from the support surface by the base.

In one aspect, the driver is coupled to the base. Further, the driver may be releasably coupled to the base so that it can be removed when not needed.

In another aspect, the apparatus includes a drive unit. The drive unit includes a housing, a motor, and the driver, with the motor operatively coupled to the driver to selectively drive the base across a ground surface.

In yet a further aspect, the drive unit includes a pair of handles, which are supported on the housing and are accessible by a person supported by the apparatus.

According to yet another aspect, the support frame is extendible to height where a person supported in the seat can stand and thereafter use the apparatus as a walker. Optionally, a sling is engageable with the support frame to provide support to a person using the apparatus as a walker.

Accordingly, the present invention provides a transport apparatus that facilitates a person moving themselves, or being moved by another person, from one support surface to another support surface or simply to allow the person to be transported from one location to another location without burdening a caregiver with the job of lifting the person.

These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENT

Referring to FIGS. 2-9, the numeral 10 generally designates one embodiment of a transport apparatus of the present invention. As will be more full described below, transport apparatus 10 allows a person to be transferred or moved from a supine position on a first surface, such a bed, stretcher, cot, or surgical table, to a sitting position off the first surface and optionally moved to another surface, such as a chair or a bed, while reducing the stress or strain on the caregiver moving the person. Further, as described in reference to a further embodiment described below, the transport apparatus may enable the person to move themselves. It should be understood that the term "transport" is used broadly to mean a transfer from one location to another location even in the same room.

Figure 1:
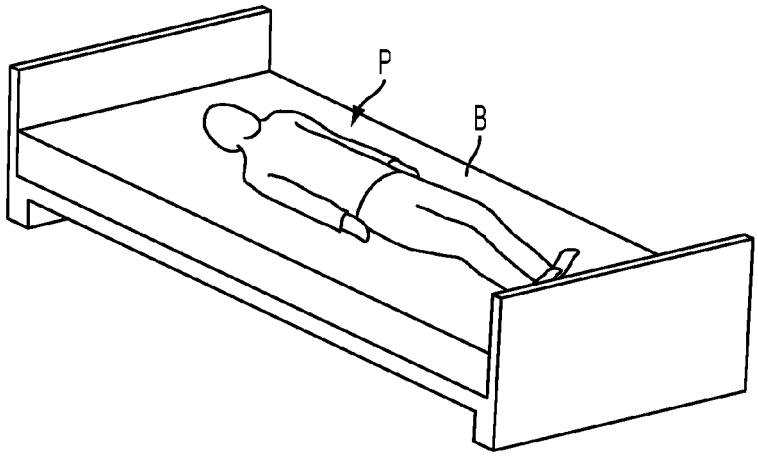
FIG. 1 is a perspective view of a person lying in a supine position on a bed.
Figure 2:
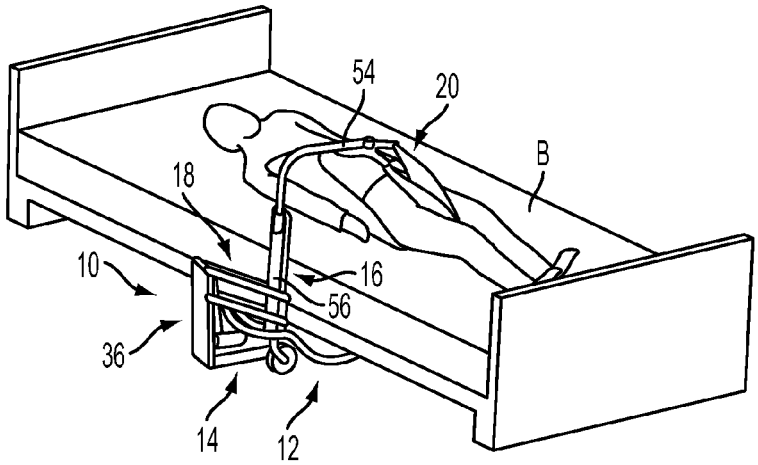
FIG. 2 is a perspective view of one embodiment of a transport apparatus of the present invention illustrating a frame and a sling of the transport apparatus positioned under the person in the supine position.

As best seen in FIG. 2, transport apparatus 10 includes a base 12, a frame 14 and a sling support 16, which is movably mounted to frame 14 by a four bar linkage assembly 18 to form a lifting arm or frame. As will be more fully described below in reference to a later embodiment, the lifting arm may be formed by telescoping supports in lieu of the linkage assembly.

To support a person, transport apparatus 10 further includes a seat formed by a sling 20. Sling 20 may be formed form a flexible sheet or panel. For example, the sheet or panel may be formed from a fabric or plastic, including a breathable or gas permeable fabric to provide enhanced air circulation to the person supported by sling 20. A suitable fabric may include GORE® Medical Fabric or the like. Further, the sling may incorporate a gel layer on top or inside the sling, such as a gel layer disclosed in copending application Ser. No. 12/640,770, filed Dec. 17, 2009, entitled PATIENT SUPPORT; and Ser. No. 12/640,643, filed Dec. 17, 2009, entitled PATIENT SUPPORT, which are assigned to Stryker Corporation, which are hereby incorporated in their entireties herein, or sold under the ISOFLEX® product name by Stryker Corporation and also anyone or more of the gel layers described in U.S. Pat. Nos. 5,749,111; 6,026,527; 6,200,284; 6,767,621; 6,099,951; 6,447,865; and 7,730,566, which are incorporated herein in their entireties.

Referring to FIGS. 5-8, sling 20 is releasably suspended and rotatably mounted to sling support 16 by a frame 22, which in the illustrated embodiment comprises a generally X-shaped frame with four generally equally spaced arms 22*a*, 22*b*, 22*c* and 22*d*. Arms 22*a* and 22*d* engage sling 20 at the upper end corners 20*a*, 20*b* of sling 20 (FIG. 5A), while arms 22*b* and 22*c* engage the central lower portions 20*c*, 20*d* of the sling 20 (FIG. 5A). For example, the arms may engage the respective portions of the sling with rings, straps, or clips, and are optionally releasably coupled to the sling so that the sling can be removed, as will be more fully described below, to deposit a person on another surface or removed for cleaning or disposal.

Figure 3:
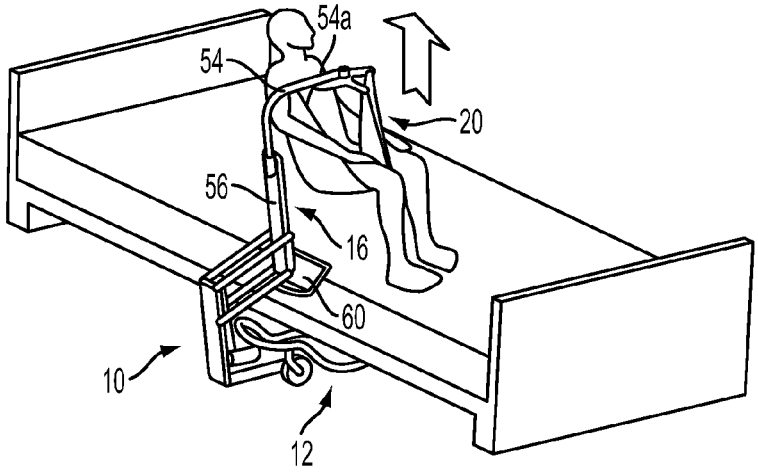
FIG. 3 is a similar view to FIG. 2 illustrating the sling moved to a raised position.
Figure 4:
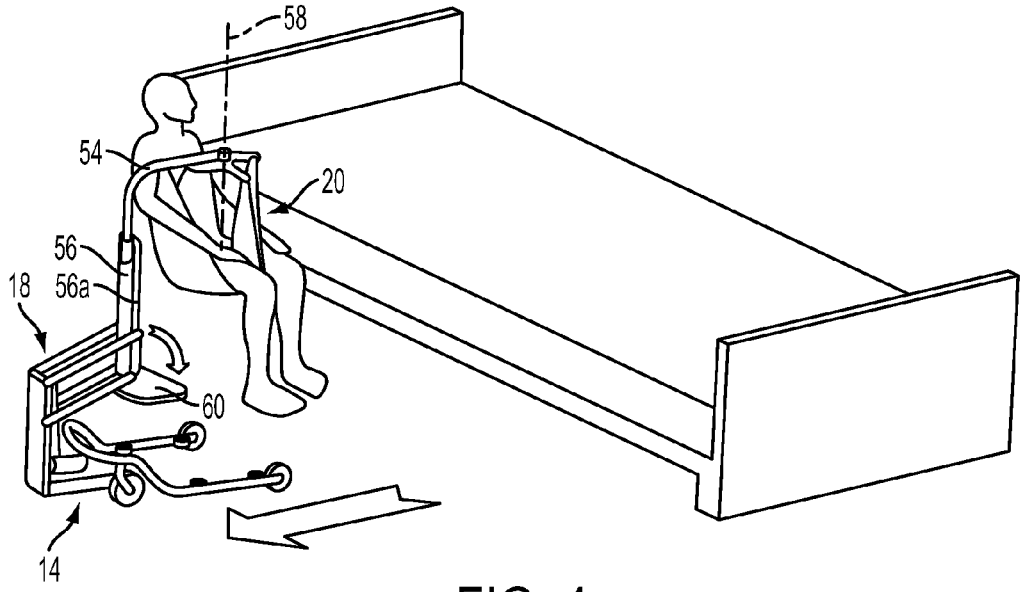
FIG. 4 is similar view to FIG. 3 illustrating the transport apparatus moved away from the bed.
Figure 5:
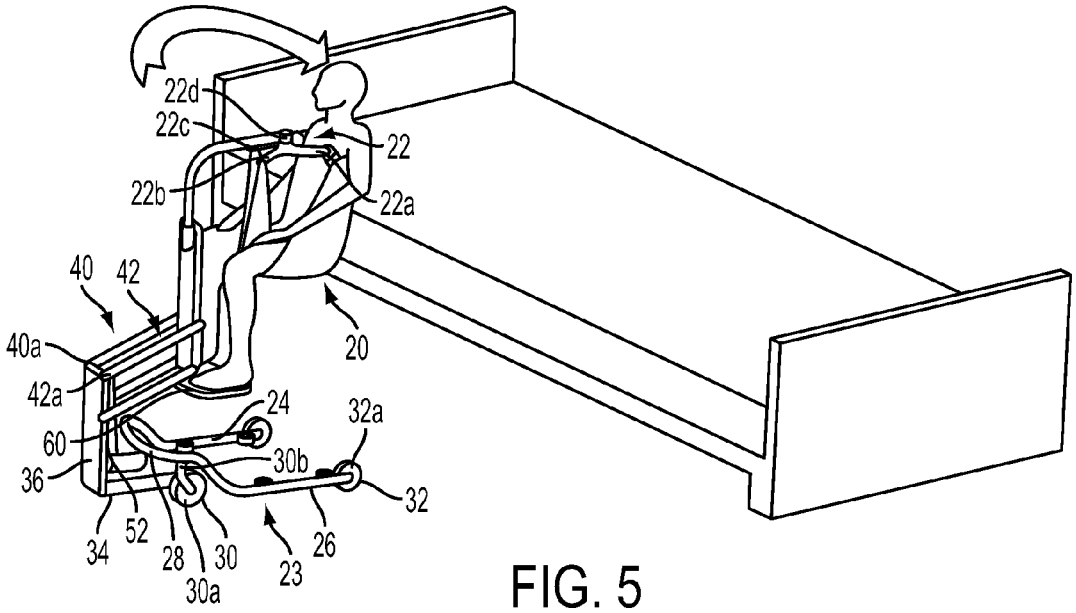
FIG. 5 illustrates the sling of the transport apparatus being rotated so that the person is facing the support frame.
Figure 5A:
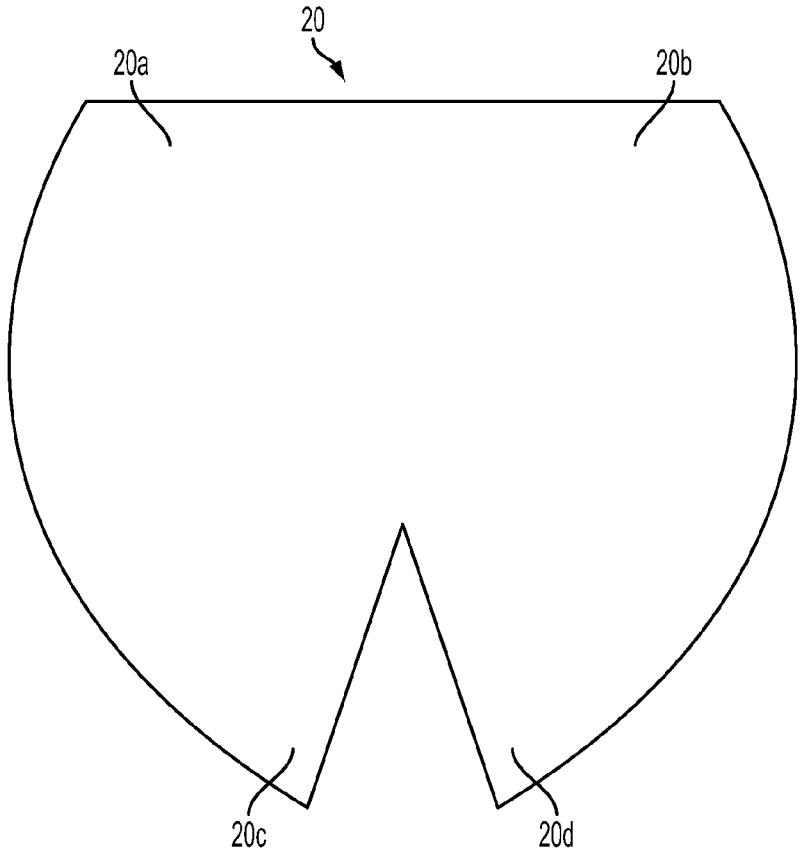
FIG. 5A is a plan view of the sling.

In this manner, sling 20 may be configured between a generally planar arrangement in which the sling may be laid generally flat on a support surface, such as a bed B, beneath a person P, such as a patient, and, further, then lifted and reconfigured into a configuration, such as shown in FIGS. 3-5, in which the sling lifts the back of the person to a seated position and, further, extends between the legs of the person to cradle the person's buttocks and legs to thereby support a person in a sitting position, described more fully below. Typically, the sling would be placed on the bed, and the patient log rolled onto the sling, which is thereafter engaged by frame 22. Therefore, in operation, when a person is lying on bed B, and a transfer of the person is desired, the sling is placed adjacent the patient, who is then log rolled onto the sling. Once on the sling, an assistant can move frame 22 over the person and then couple the frame to the sling. After the frame is properly engaged with or coupled to the sling, the four bar linkage assembly can be raised to lift the sling to maneuver the person into a seated position. Once the person is in the seated position, the person may lifted off the bed to allow the person to be transferred from the bed, as previously noted, to another location or to another support surface. It should be understood for a person who has some upper body mobility, that the person may place themselves on the sling and maneuver themselves into position and further position the support frame to engage the sling so that the person may use apparatus 10 to move themselves off, for example, a bed, as will more fully described below. Other examples of suitable slings are described in U.S. Pat. No. 6,938,285, which is incorporated by reference herein in its entirety.

In the illustrated embodiment, base 12 is formed from tubular metal members, which are joined together, such as by welding, to form a rigid U-shaped frame 23 with arms 24 and 26 extending or cantilevered from a cross-frame member 28, similar to the base disclosed in copending application Ser. No. 12/774,365, filed May 5, 2010, entitled TRANSPORT APPARATUS, which is incorporated by reference herein in its entirety. Further, as described, base 12 comprises a movable base with a forward set of bearings 30 and a rearward set of bearings 32. In the illustrated embodiment, bearings 30 comprise wheels 30*a*, which are rotatably mounted to base 12 about a vertical axis as well as a horizontal axis by yokes 30*b* to provide steering. Bearings 32 may also comprise wheels 32*a* that are mounted about a fixed rotational axes at the rear most end of frame 23 and, further, which have a low profile so that frame 23 and wheels 32*a* may be extended under a bed or other support surface or apparatus, such as table, desk or under a vehicle body, with no or low clearance. Alternately, the bearings may comprise casters, low friction pads or skids, air bearings, or the like or a combination of different types of bearings. An example of a suitable low profile bearing is described in U.S. Pat. No. 7,441,786, entitled CONVERTIBLE LOW PROFILE ROLLER AND SUPPORT BASE, issued Oct. 28, 2008, which is commonly owned by Stryker Corporation of Kalamazoo, Mich. and incorporated by reference herein in its entirety. As described in the referenced patent, the casters may be reoriented so that their height, and hence the height of the base at least at the casters, can be reduced to extend under another support with a low clearance. Additionally, as will be more fully described in reference to FIGS. 10 and 11, base 12 may be configured so that it can spread or increase its width to straddle a support surface, such as a chair, which also can increase the stability if the apparatus.

As best seen in FIG. 5, frame 14 extends from base 12 and includes an inverted channel-shape member 34 and an upright support 36 that is secured to member 34, for example, by fasteners or welds or the like, and extends upwardly from member 34 to provide a mounting surface for linkage assembly 18. Frame 23 is rigidly secured to inverted channel-shaped member 34 by, for example, welds, brackets, and/or fasteners. In the illustrated embodiment, support 36 also comprises a channel member with linkage assembly 18 pivotally anchored on one end in the webs of support 36. As best seen in FIGS. 2-9, four bar linkage assembly 18 includes two four bar linkages 40 and 42, which are pivotally mounted at their proximal ends to the webs of member 36, for example, by transverse rods (not shown). Further, four bar linkages 40 and 42 are pivotally connected to support 16, for example, by transverse rods (not shown) that extend through support 16.

The upper bars 40*a* and 42*a* of four bar linkages 40 and 42 are also interconnected by an additional transverse member or rod 50, which provides an engagement structure for a lifting driver 52, which is mounted on one end to channel member 34 and at its opposed end to rod 50 so that when extended or contracted, support 16 is raised or lowered. For example, a suitable driver includes an electric linear driver, such as a Linak® linear actuator, or a hydraulic cylinder. Driver 52 may be powered by an onboard power supply, such as a battery or pump and battery, also mounted to member 34.

Optionally, a controller may be provided for driver 52 that has discrete positions or may provide an infinite number of positions to enhance the control over the position of sling 20. Further, apparatus 10 may include a user actuatable control, such as a button or buttons, mounted to frame 14 to allow driver 52 to be operated by the person being transported or by a caregiver. Alternately or in addition, a remote control device or pendant control may be used to operate driver 52. In addition, as will described in the reference application, transport apparatus 10 may be driven across a surface, for example, by a ground engaging driver, such as a powered hub motor wheel, and further may be driven by the person supported by the apparatus. Further, as will be more fully described below, transport apparatus 10 may incorporate a footrest 60.

Referring again to FIGS. 2-9, support 16 is mounted to the distal end of linkage assembly 18 and includes a generally L-shaped lifting arm 54 that is cantilevered for extending over a horizontal surface, such as a bed B, as shown in FIG. 2. Support 16 also includes a vertical member or base 56, such a tubular member 56*a*, which receives the lower proximal end of arm 54. Arm 54 therefore may be moved so that its horizontal portion 54*a*, which supports frame 22, extends over the surface of the bed so that the sling that is positioned under the patient may be engaged by the frame and then lifted by driver 52. In this manner, a person laying the bed may be moved from their supine position (see FIG. 2) to a seated position (FIG. 3), and then lifted off the bed and thereafter rotated by frame 22 so that the person faces upright support 36. For example, frame 22 may be rotatably supported by arm 54, for example, by a high friction connection or a spring release ratchet so that an attendant or caregiver can simple manually rotate the person. Alternately, a driver may be added to facilitate rotation of frame, and hence the person.

Referring to FIGS. 7A-7C, transport apparatus 10 may also incorporate a footrest 60, which allows the person to rest their feet when being transported, which can help stabilize the person. Footrest 60 may be fixed, for example, to base 56 by a bracket or may be movably or pivotally mounted to base 56 so that the foot rest may be folded or moved to stowed position when not in use so that the range of motion of support 16 is not limited by footrest 60. An example of the footrest and mounting arrangement are described and shown in the referenced related applications.

Figure 6:
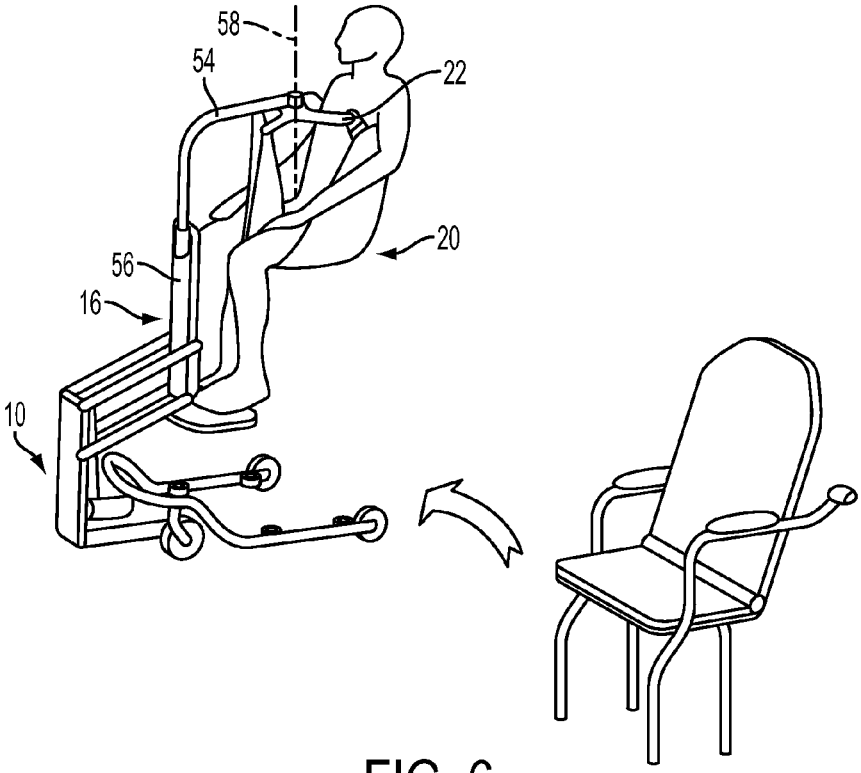
FIG. 6 is a similar view to FIG. 5 illustrating the transport apparatus approaching a chair.
Figure 7:
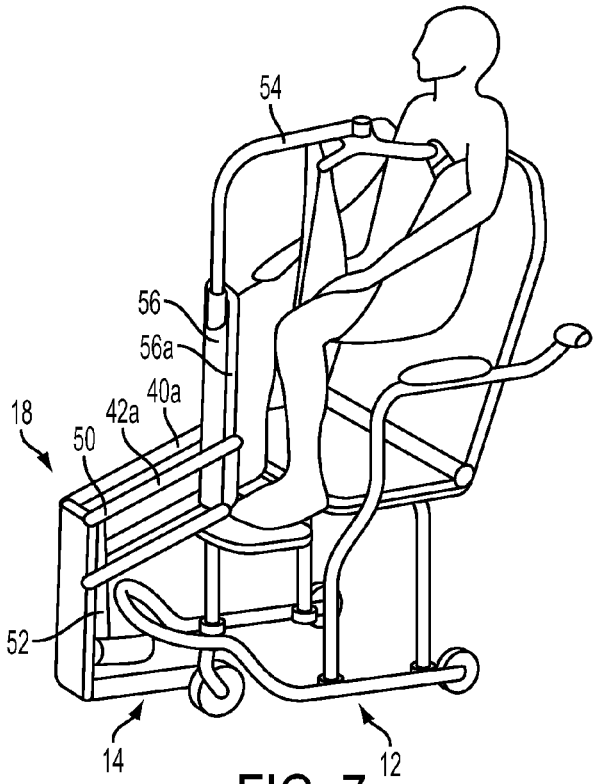
FIG. 7 is similar view to FIG. 6 illustrating the transport apparatus lowering the sling and person supported thereon onto the chair.
Figure 9:
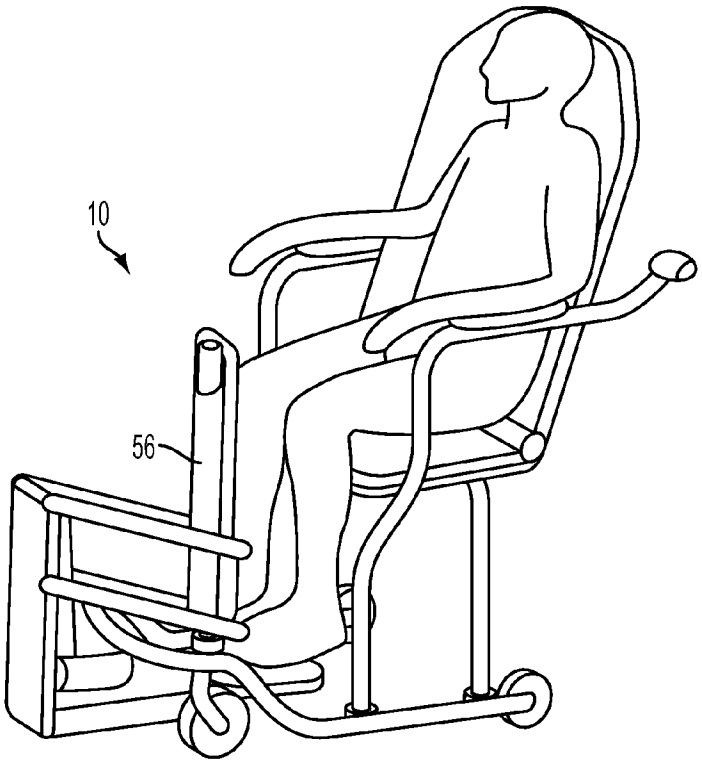
FIG. 9 illustrates the sling disengaged from the frame.
Figure 8:
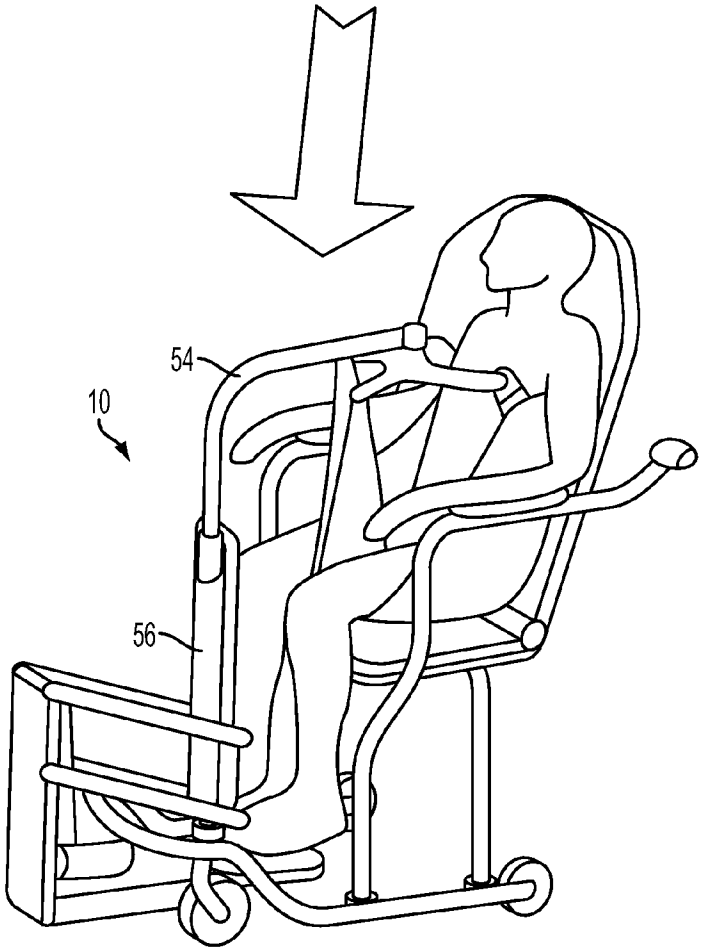
FIG. 8 illustrates the sling of the transport apparatus lowered such that the person is seated in the chair.

As best understood from FIGS. 1-9, when a person is lying in a supine position on a bed, and after the sling has been located under the person, apparatus 10 may be moved or driven to the side of the bed. Once bedside, arm 54 can be extended over the person and frame 22 coupled to the sling. Once coupled, the driver may be activated to lift the four bar linkage, which lifts arm 54 and sling 20 and the person supported on the sling. By attaching the frame to the various corners of the sling, when the arm is lifted, the sling will raise the person into a seated position and then lift the person off the bed. Once off the bed, apparatus 10 can be moved away from the bed, and then the frame 22 can be rotated to thereby reorient or reposition the person to face the upright support 36. The person may be then transported, for example, to a chair as shown in FIG. 6, and then lowered onto the chair (FIGS. 7-9) and thereafter the sling maybe removed or simply disconnected from the frame.

Figure 10:
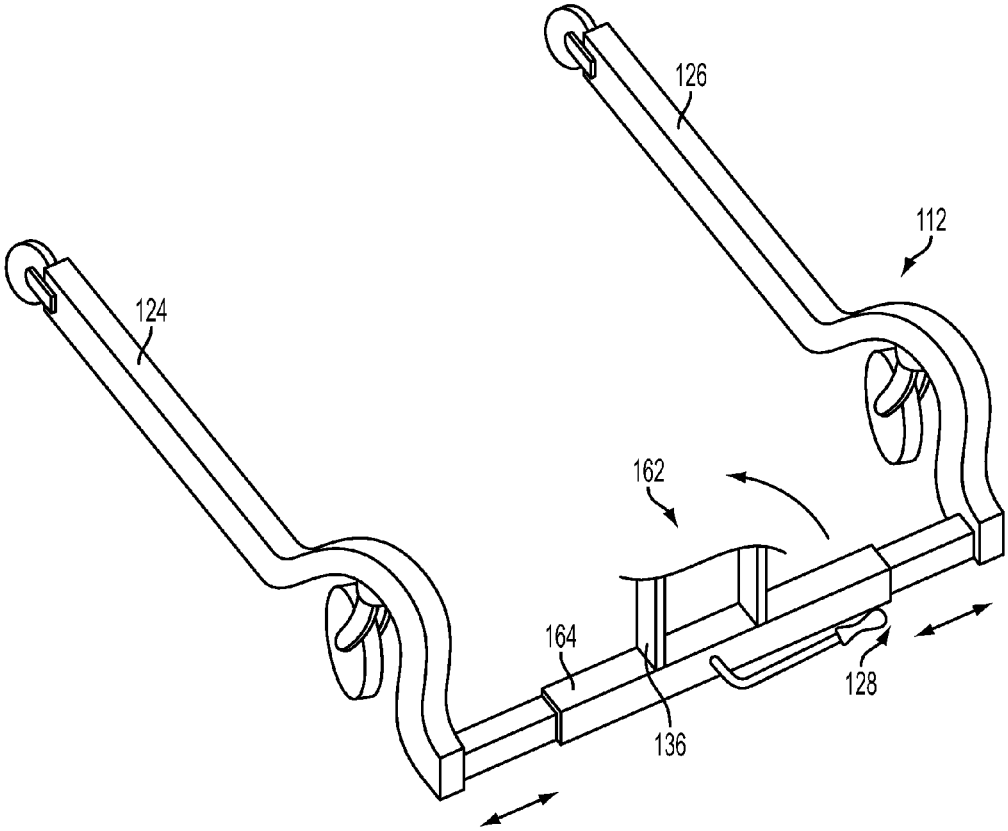
FIG. 10 is a perspective view of another embodiment of a base of a transport apparatus of the present invention.
Figure 11:
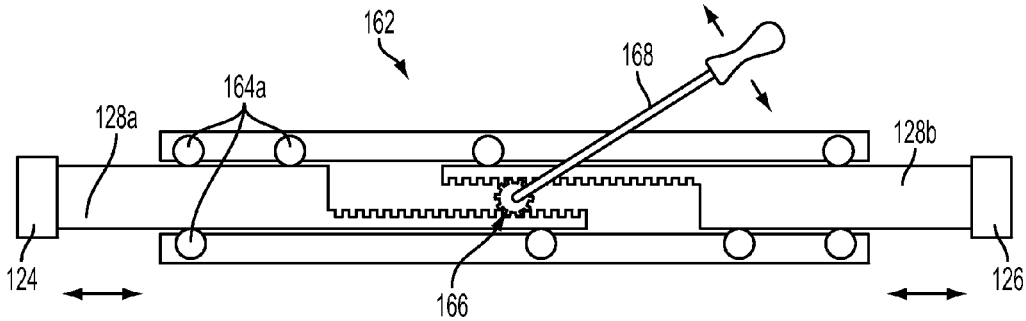
FIG. 11 is a cross-section elevation view of the adjustment mechanism of FIG. 10.
Figure 12:
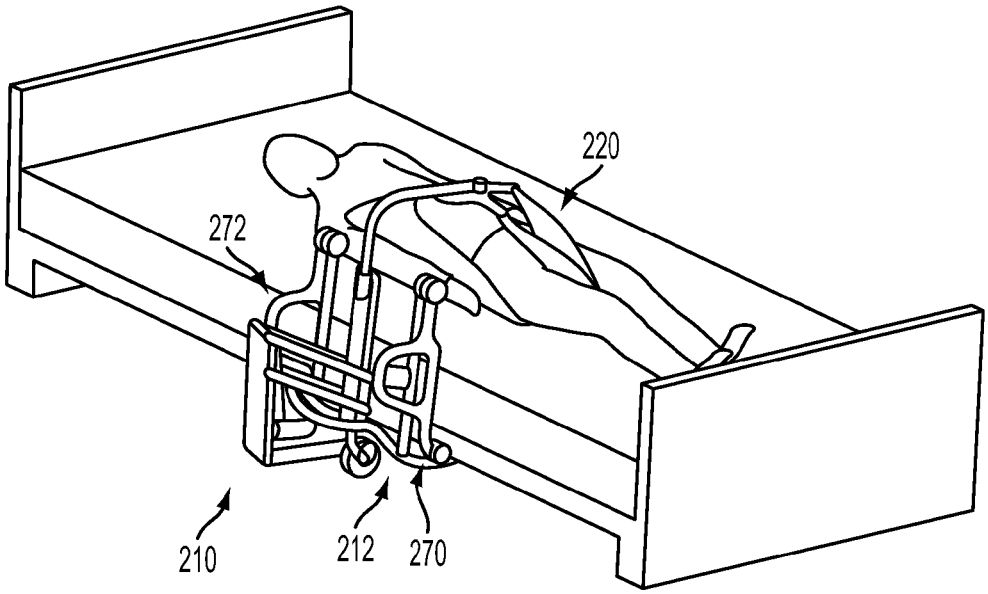
FIG. 12 is a perspective view of another embodiment of a transport apparatus of the present invention.
Figure 13:
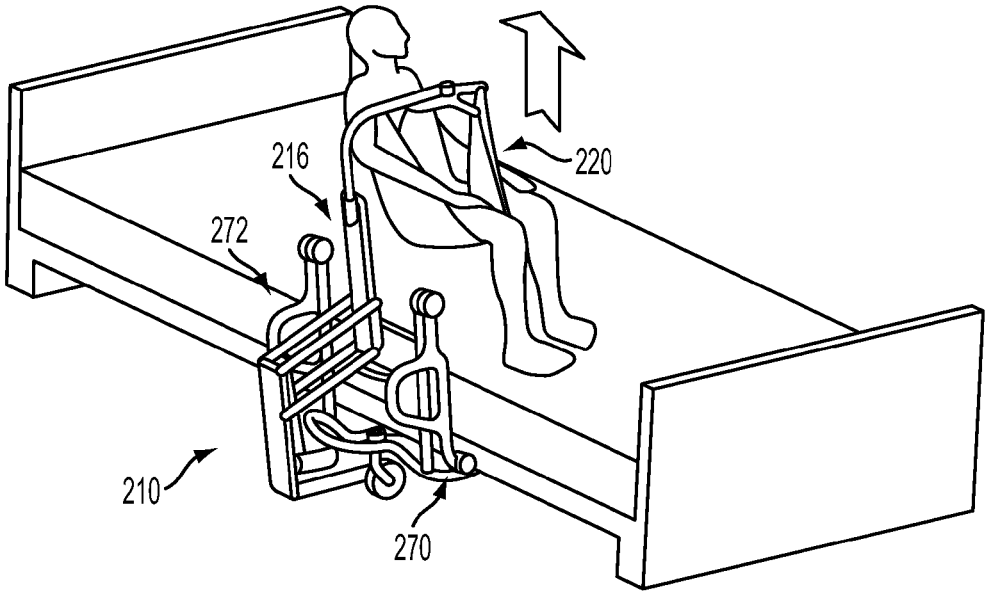
FIG. 13 is a perspective of the transport apparatus of FIG. 12 illustrating the transport apparatus lifting a person from the bed.
Figure 14:
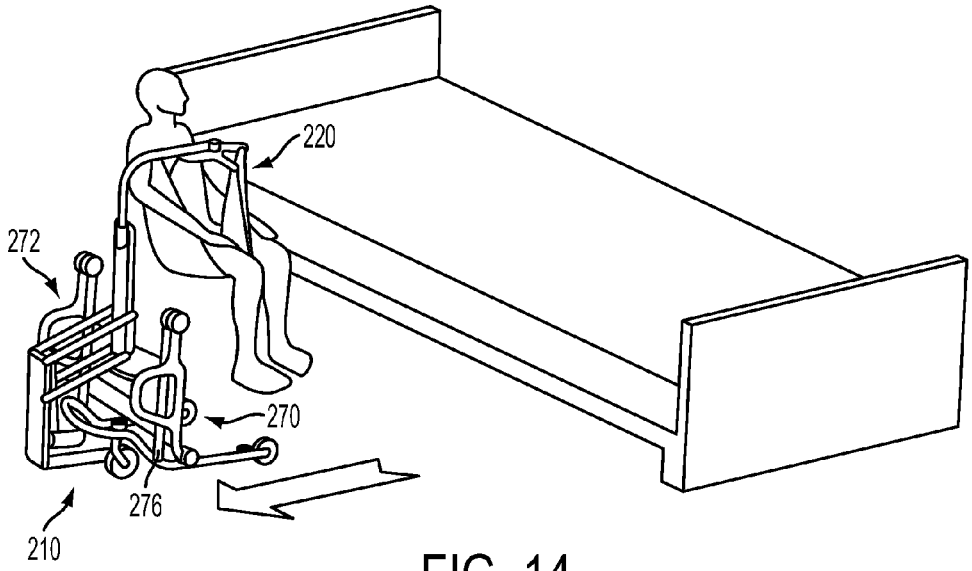
FIG. 14 is a similar view to FIG. 13 illustrating the transport apparatus of FIG. 13 moved away from the bed.
Figure 15:
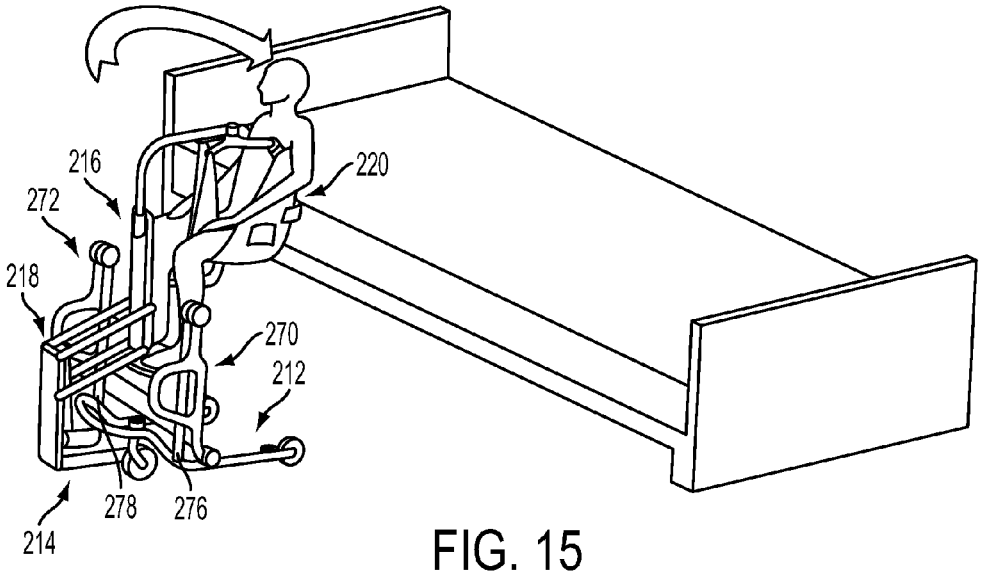
FIG. 15 is a similar view to FIG. 14 illustrating the person rotated facing the frame of the transport apparatus.

Referring to FIG. 10-11, the numeral 112 designates another embodiment of the base. Base 112 incorporates an extension/retraction mechanism to widen or narrow the base so that the base foot print may be increased or decreased when needed, for example, when the patient is deposited onto a surface, such as a chair or table with a base that does not have enough clearance or room for the arms 124, 126 of base 112, or when greater stability for the base is needed, for example, when transporting a bariatric patient. For further details of the linkage assembly, sling support, and sling reference is made to the first embodiment.

As best seen in FIG. 10, extension/retraction mechanism 162 is located and incorporated into cross-frame member 128 and includes a tubular member 164, which supports an upright support 136, similar to upright support 36, and a rack and pinion assembly 166 (FIG. 11). Cross-frame member 128 is divided into two members 128*a*, 128*b*, with the rack and pinion assembly located and interposed between the two ends of members 128*a*, 128*b* to extend or contract the two members along their longitudinal axes to increase or decrease the width of the base. The rack and pinion assembly and two ends of member 128*a*, 128*b* are supported by, for example, bearings 164*a*, such bearing surfaces, for example, surfaces that are lubricated, or bearing devices, for example, ball bearings, rollers, or the like, which are provided on the inside of tubular member 164 and contact the outer surfaces of members 128*a*, 128*b*. Mounted to the pinion is a handle 168, which extends through tubular member 164 to provide a manual driver for the rack and pinion. Thus when the handle is rotated, the width of the base may be increased or decreased depending on the direction of rotation. It should be understood that a driver, such as an electric motor, may also be provided to drive the pinion, which may also be actuated by the controller. Further, other extension/retraction mechanisms or devices may be used in lieu of the rack and pinion assembly, including a linkage assembly that contracts or expands when actuated or the like.

Referring to FIGS. 12-19, the numeral 210 generally designates another embodiment of the transport apparatus. Similar to the previous embodiment, transport apparatus 210 includes a base 212 and a movable sling support 216, which supports a seat in the form of a sling 220. Similar to the previous embodiments, apparatus 210 permits a person to be lifted off a support surface using sling 220 and then transferred to another support surface or simply transported to allow the person to engage in activities, such as reading or writing at a desk or to allow the person to use a commode, or to allow the person to be transported in or drive a vehicle. For further details of the base 212, support 216, the linkage assembly, and sling 220, reference is made to the first embodiment.

In the illustrated embodiment, base 212 also includes a seat frame formed by two deployable sling support arms 270, 272, which provide additional support and stability to sling 220 so that a person may be transported by apparatus 210 and not merely transferred by the apparatus. In this manner apparatus 210 may be used as a means of transportation, similar to a wheelchair.

Arms 270, 272 are mounted to two upright frame members 276, 278 that extend upwardly from and are mounted to base 212. For example, members 276, 278 may be welded or removably mounted to the base. Arms 270, 272 are pivotally mounted at or adjacent the upper ends of members 276, 278, for example, by pivot shafts or cylinders that are supported in bushings or the like, which may be locked in position, for example, by friction or mechanical locks, such as pins, spring biased latches, or the like, when arms 270, 272 are fully raised and when fully lowered. For example, the pivot connections may incorporate a clutch mechanism that locks the support in position but which can be released by disengaging the clutch.

Figure 17:
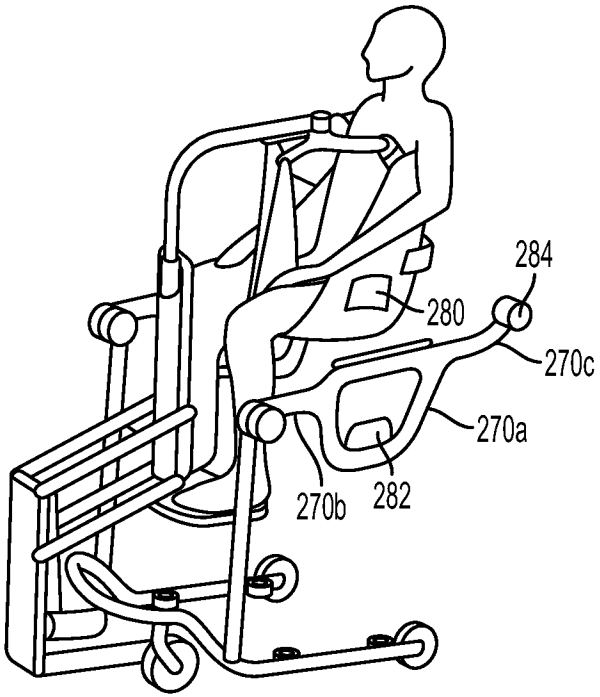
FIG. 17 is a similar view to FIG. 16 illustrating both arms of the seat frame of the transport apparatus raised.
Figure 16:
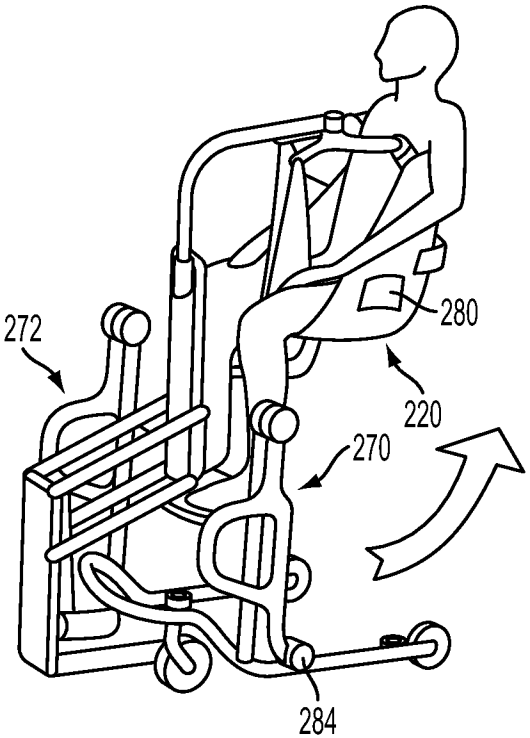
FIG. 16 is a similar view to FIG. 15 illustrating one of the arms of the seat frame raised.
Figure 19:
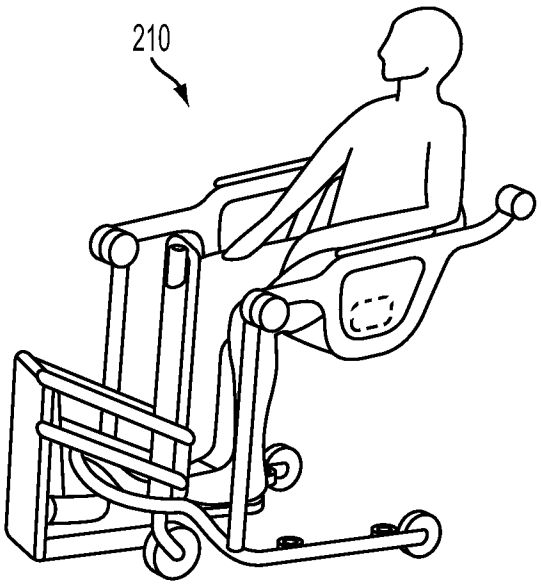
Figure 18:
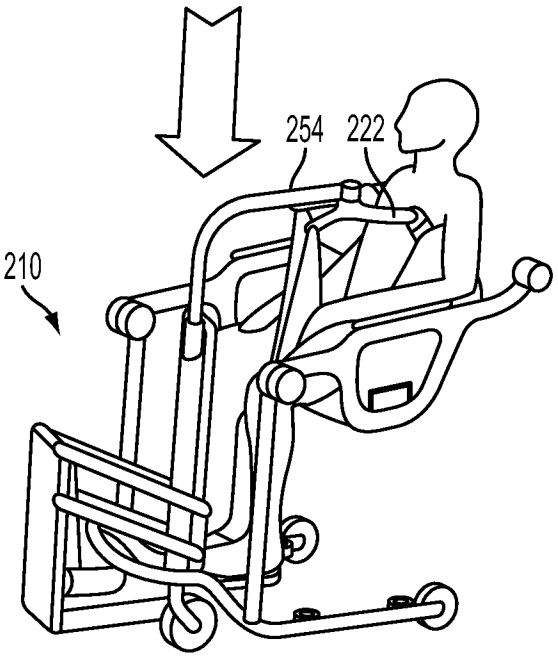
FIG. 18 illustrates the sling lowered to engage the seat frame.

When moved to their raised positions (FIG. 17), arms 270, 272 can support sling 220 (FIGS. 18 and 19). As best seen in FIGS. 16 and 17, sling 220 incorporates engagement structures, such receptacles, for engagement by arms 270, 272, which incorporate corresponding structures, such as protecting members or frames, to engage the sling by extending into the receptacles. In the illustrated embodiment, sling 220 incorporates receptacles in the form of pockets 280 on either side of the sling adjacent the portion of the sling, which wraps around the person's thighs. Arms 270, 272 incorporate inverted U-shaped members 282 that project upwardly for receipt into pockets 280 when arms 270, 272 are raised and sling 220 is lowered between arms 270, 272. Optionally, members 282 may be a solid plate or may be formed by two or more members. Further, members 282 may be movably mounted, for example, pivotally mounted so that they can be moved between a stowed position and an operative position for extending into pockets 280.

Figure 20:
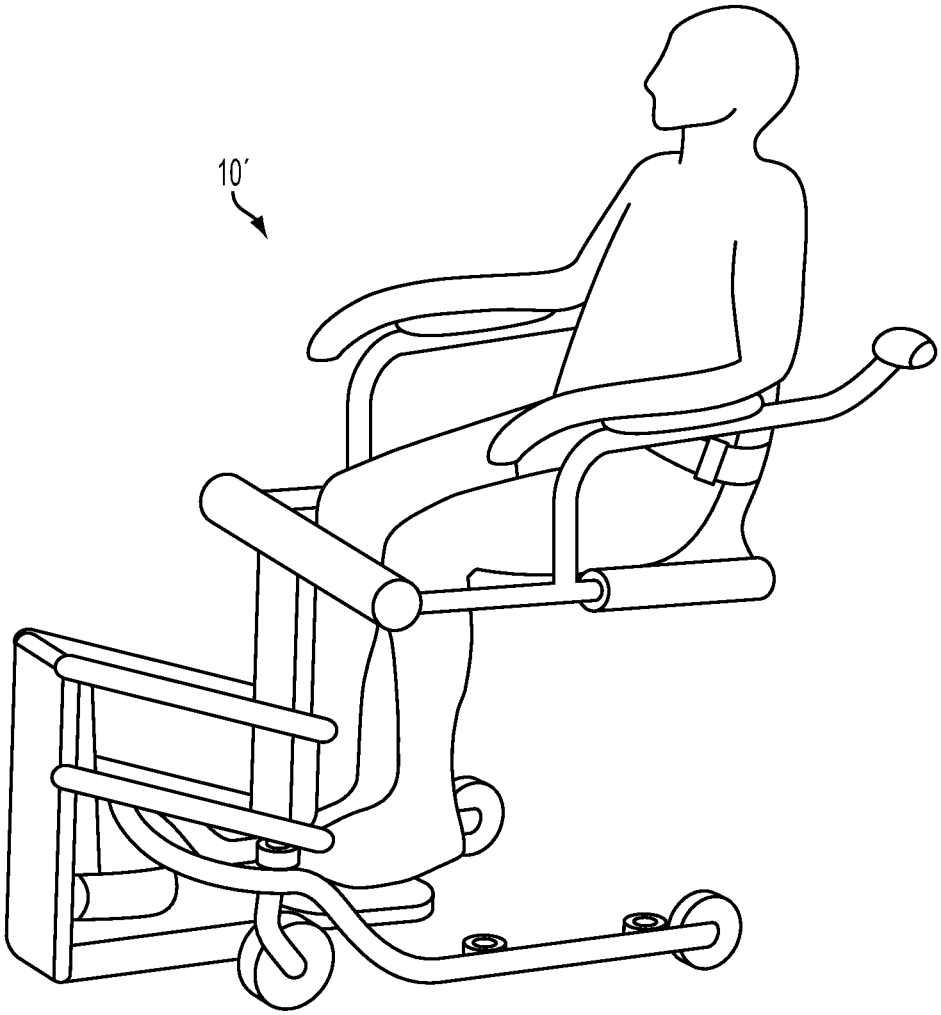
FIG. 20 is a perspective view of another embodiment of a transport apparatus.

It should be understood, as in the case of all the components of apparatus, the shape and configuration of arms 270, 272 may vary depending on the material used and the type of structural components that are used to form the arms. In the illustrated embodiment, arms 270, 272 are formed from metal tubular members that are each configured with a central looped portion 270*a*, 272*a* and with two cantilevered arm portions 270*b*, 270*c*, 272*b*, 272*c* extending from the looped portions 270*a*, 272*a*. Cantilevered arm portions 270*b*, 272*b* mount arms 270, 272 to upright supports 276, 278, and cantilevered arm portions 270*c*, 272*c* extend from looped portions 270*a*, 272*a* to provide handle holds for a caregiver to allow the caregiver to move and manipulate apparatus 210. For example the distal ends of arm portions 270*c*, 272*c* may incorporate hand grips 284. These hand holds may be also be incorporated into the apparatus 10', which described in related application U.S. patent application Ser. No. 12/774,365, entitled TRANSPORT APPARATUS, filed May 5, 2010, such as shown in FIG. 20.

Once sling 220 is engaged by arms 270, 272, the frame (222) may be disengaged from sling 220 (FIG. 19). After being disengaged from sling 220, arm 254 (similar to arm 54) may then be moved to a stowed position (e.g. folded) or may be removed. In this manner, apparatus is then transformed into a support apparatus that can convey a person either to another location or simply transfer a person off a bed where the person may remain seated in the apparatus.

Referring to FIGS. 21-27, the numeral 310 designates yet another embodiment of the transport apparatus, which is of similar general construction to the transport apparatus in the referenced, related applications noted above. For further details of the sling 320 reference is made to the related applications. In the illustrated embodiment, apparatus 310 includes a base 312 and a movable frame 314 to which sling 320 is removably mounted in a similar manner to the sling of the transport apparatus described above. Base 312 is formed by two generally parallel arms 324 and 326 with front and back bearings, in the form of wheels 330, 332 similar to wheels 30, 32 described above and in the referenced applications.

Figure 23:
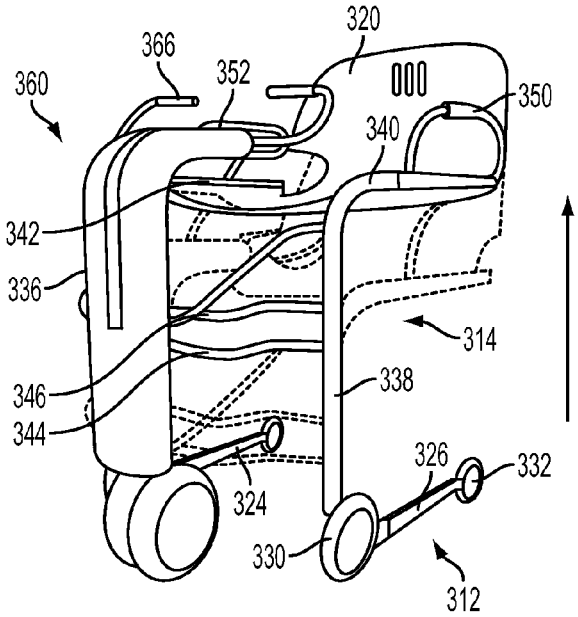
FIG. 23 is a similar view to FIG. 22 with a drive unit mounted to the apparatus.

Arms 324 and 326 are held in their spaced relationship by an inverted L-shaped frame 314, which includes two generally horizontal, generally parallel arms 340, 342 and two spaced apart generally parallel upright supports 336, 338, which are interconnected by cross-brace members 344, 346 (FIG. 23). Upright supports 336, 338 are rigidly connected, such as by welds or fasteners, to arms 324 and 326 of base 312 so that together with the base they form a generally C-shaped frame. As described the referenced, related patent applications, sling 320 may include two sleeves 320*a*, 320*b* into which the distal ends of arms 340, 342 extend to mount the sling on frame 314.

To raise and lower sling 320, upright supports 336 and 338 are configured as telescoping supports, which are extended or retracted by drivers, such as electric linear drivers, such as a Linak® linear actuator, or a hydraulic cylinder or the like. Cross-brace members 344 and 346 are mounted to the movable telescoping members of supports 336, 338 so that as the telescoping members extend, cross-brace members 344 and 346 will be raised along with sling 320. In this manner, and as described in the referenced applications arms 340, 342 may be raised to engage the sling to raise a person off a first surface, such as a bed or chair or the like, and then if needed lowered to allow the person to be deposited on another surface.

Figure 22:
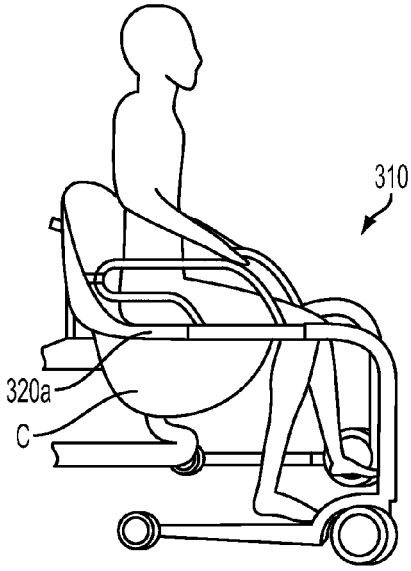
FIG. 22 is a side elevation view of the apparatus of FIG. 21 with the apparatus positioned over a commode.

As noted in the referenced copending application and best understood from FIG. 22, sling 320 may be configured to have a central opening to allow a person to use a commode C without removing the sling. Ideally, at least in this embodiment sling 320 may be disposable to avoid infection and contamination.

Arms 340 and 342 may also include arms rests 350, 352 similar to the arm rests provided in the referenced applications, which also provide an attachment point for the back of the sling. Arm rests 350, 352 can be formed by tubular members that are configured as looped portions, which extend upwardly from the arms and extended rearwardly toward the back portion of the sling so that the sling can be secured by way of straps that loop through and around the tubular members, which form the arm rests.

Figure 27:
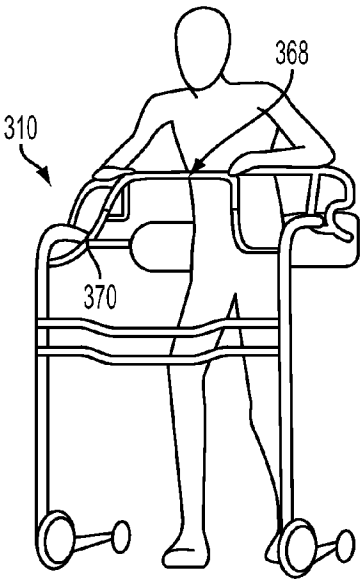
FIGS. 24-27 illustrate raising of the sling and the conversion of the apparatus of FIG. 23 into a walker.
Figure 26:
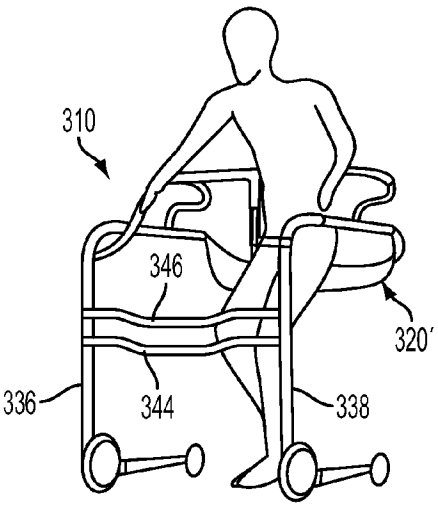
Figure 25:
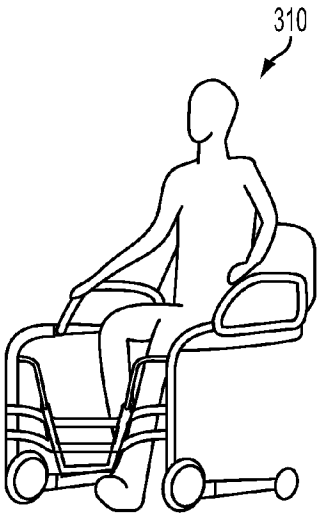
Figure 24:
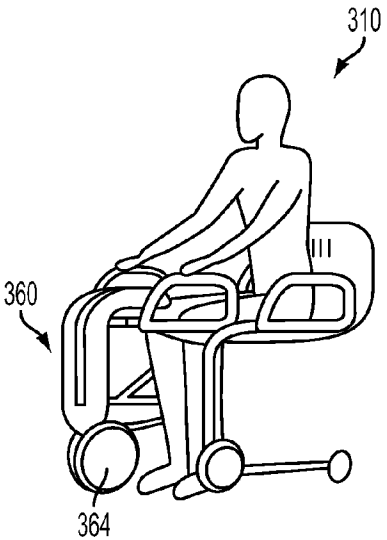

Alternately, the apparatus may be employed without sling 320, and instead used as a walker, such as shown in FIGS. 26 and 27. For example, once the person is raised off the first surface and arms 340, 342 are raised to a height that is suitable for the person to lower their feet to the ground and support themselves on the ground (e.g. with assistance from a caregiver or simply by holding onto arms rests 366), sling 320 may be removed and optionally replaced with a stabilizing sling 320'. Sling 320' may be in the form of a wide strap that is secured at its opposed end to arms 340, 342 and either provide support to the person's backside or legs, such as shown in FIG. 26, or may simply provide lateral support to the person's mid to lower back (FIG. 27). In this manner, apparatus 310 may be converted into to a walker.

When used as a walker, additional support handle(s) 368, for example, in the form of an inverted generally U-shaped cross-bar 370, may be provided at the front of apparatus, which extends between upright supports 336 and 338. Cross-bar 370 may be joined with supports 336, 388, such as by welds or fasteners, and further may be removable mounted so that when in use as a powered transport apparatus, which is more fully described below, the cross-bar will not interfere with the control of apparatus 310. Alternately, the cross-bar may provide support to or an attachment surface for the drive units described below.

Referring to FIG. 23, apparatus 310 may also be powered. For example, apparatus 310 may incorporate a translational driver 360 so that a person supported by apparatus 310 may control their forward and reward motion. In the illustrated embodiment, driver 360 comprises a separate drive unit that can be mounted or incorporated into apparatus 310 to provide motive power but then optionally removed when motive power is not needed.

Figure 21:
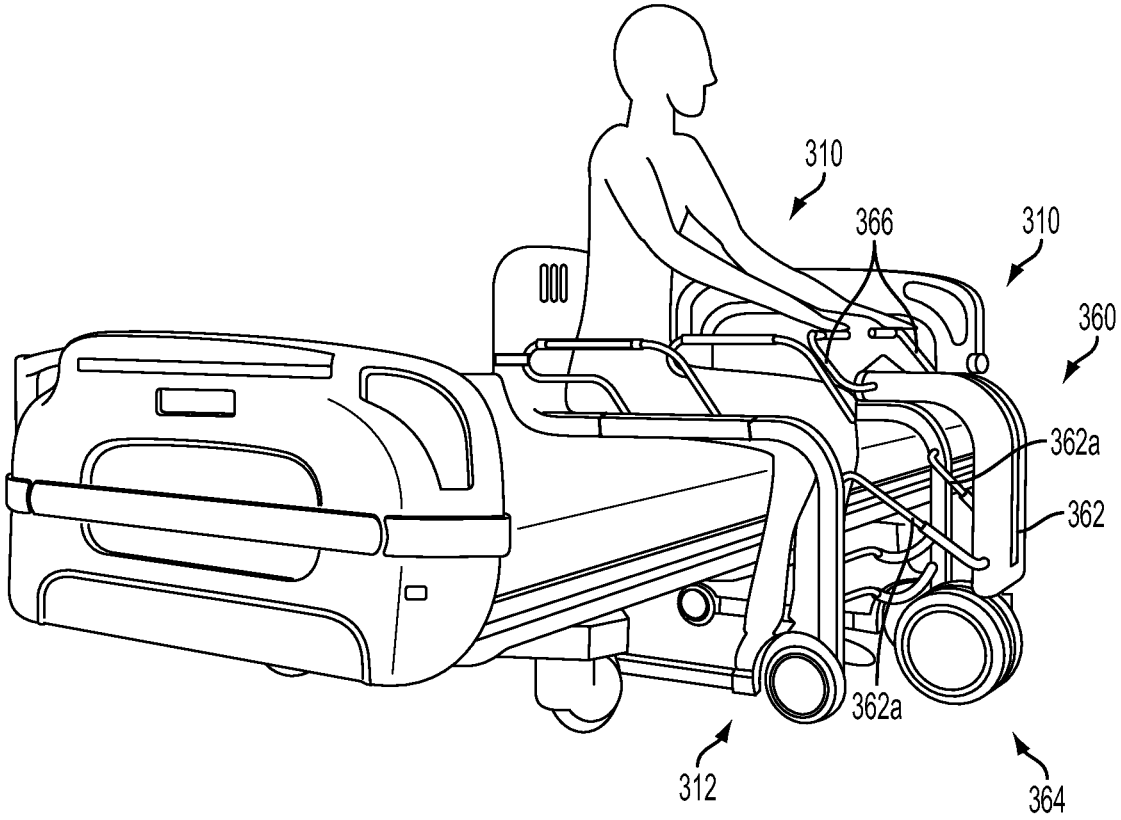
FIG. 21 is a perspective view of another embodiment of the transport apparatus of the present invention.

As best seen in FIG. 21, driver 360 includes an electric motor (not shown) and an inverted L-shaped housing 362, which optionally houses the motor (and associated wiring and controls) and which supports a wheel and hub assembly 364 driven by the motor. It should be understood that the hub and wheel assembly may alternately house the motor. Housing 362 also supports handles 366, for example, in the form of L-shaped arms, for the person to engage and optionally control the driver. For example, user actuated controls, such as buttons or the like, may be mounted at the handles to control the motor. Optionally, handles 366 may incorporate load cells for controlling the motor, such as described in co-owned U.S. Pat. No. 6,772,850 issued to Waters et al, and entitled POWER ASSISTED WHEELED CARRIAGE, which was filed on Jan. 21, 2000 and assigned to Stryker Corporation of Kalamazoo, Mich., and the complete disclosure of which is incorporated herein by reference in its entirety. Also, apparatus 310 may incorporate a speed control system to improve the ease of maneuvering apparatus 310, such as described in copending U.S. patent application, Ser. No. 12/577,355, entitled SPEED CONTROL FOR PATIENT HANDLING DEVICE, filed Oct. 12, 2009, which is also incorporated by reference in its entirety herein and also commonly assigned to Stryker Corporation.

As described above, driver 360 may be removable coupled or mounted to apparatus 310. In the illustrated embodiment, housing 362 is connected to upright supports 336 and 338 by bars or rods 362*a*, which are connected on one end to members 336 and 338 and their other members to housing 362.

Accordingly, the various transport apparatus of the present invention allow a person to be transferred from one support surface, such as a bed, stretcher, table, or a cot to another support surface, such as chair, car seat, wheelchair or a seat on a commode, or may be just simply used to transport the person.

While reference is made herein to the various components as "members," it should be understood that this term is used broadly and may encompass a wide variety of structural members including rods, tubular, angles, plates, for example, and further typically metal structural members, such as aluminum or stainless steel, though it should be understood that other materials may be used. Further, each member may be formed from one or more members. Additionally, while several components have been described as separate members, some members may be combined. In addition, the terms "mounted" or "connected" to are used in their ordinary sense and includes the use of welds or fasteners, as would be understood by those skilled in the art.

While several forms of the invention have been shown and described, other forms will now be apparent to those skilled in the art. Further, features of one embodiment may be combined with features of other embodiments. For example, while a single powered hub and wheel assembly is illustrated, it should be understood that multiple powered hub and wheel assemblies may be provided and, further, may be used to steer the vehicle by selectively and independently powering the wheels. Further, the individual wheels may be powered. It also should be understood that in any of the embodiments described herein, the footprint of the respective apparatus may be increased or decreased depending on the application. For example, for home use, the transport apparatus may be configured to have a footprint that clears standard doorways. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or privilege is claimed are defined as follows:

1. A transport apparatus comprising:

a base;

a sling;

a support frame mounted to said base, said support frame including a lifting sling support extending over said base and being configured to move from a first position spaced above said base at a first height wherein the sling support may be extended over and proximate a support surface for engaging said sling when placed on the support surface to a second position spaced above a second height greater than said first height once engaged with said sling wherein said sling is raised above said support surface, said sling support including a rotatable sling frame, said sling frame providing support to the sling when engaged with said sling, and said sling frame being rotatable relative to said lifting sling support about a vertical axis wherein when said sling support and said sling frame are raised to said second position above the support surface a person supported on said sling may be lifted off the support surface from a first orientation with said sling and moved away from said support surface by said base and then rotated about said vertical axis to an orientation generally orthogonal to said first orientation to facilitate depositing the person on another support surface; and a seat frame, said seat frame configured to support said sling, and said seat frame being movable from a stowed position to an operative position engaging and supporting said sling in addition to or instead of said sling support.

2. The transport apparatus according to claim 1, wherein said sling comprises a panel of flexible material.

3. The transport apparatus according to claim 1, wherein said sling includes receptacles for receiving a portion of said seat frame.

4. The transport apparatus according to claim 1, wherein said base comprises:

a movable base, said movable base having a footprint and a height, and said movable base being adaptable to accommodate another support surface by increasing or decreasing its footprint or height wherein a person supported by said sling may be deposited with said sling on the other support surface when said sling support is extended over the other support surface.

5. The transport apparatus according to claim 4, further comprising a translational driver, said driver being operable by a user or a person supported by said transport apparatus to move said apparatus across a ground surface.

6. The transport apparatus according to claim 4, wherein said seat frame comprises a pair of deployable arms, said arms movable between a non-deployed position and a deployed position for engaging said sling and limiting said sling frame from rotation to thereby proving lateral support to said sling.

7. The transport apparatus according to claim 4, wherein said movable base includes two base frames coupled together to form two sides of said base, and said base frames being movable relative to each other to adjust the footprint of said base.

8. The transport apparatus according to claim 7, further comprising an actuator for moving said base frames relative to each other.

9. The transport apparatus according to claim 8, further comprising a handle, said handle operatively coupled to said actuator to allow manual adjustment of said actuator and said footprint.

10. A transport apparatus comprising:

a base;

a sling; and a support frame mounted to said base, said support frame including a sling support extending over said base and being configured to move from a first position spaced above said base at a first height wherein the sling support may be extended over and proximate a support surface for engaging said sling when placed on the support surface to a second position spaced above a second height greater than said first height once engaged with said sling wherein said sling is raised above said support surface, said sling support including a rotatable sling frame providing support to the sling when engaged with said sling, and said sling frame being rotatable relative to said sling support about a vertical axis wherein when said sling support and said sling frame are raised to said second position above the support surface a person supported on said sling may be lifted off the support surface from a first orientation with said sling and moved away from said support surface by said base and then rotated about said vertical axis to an orientation generally orthogonal to said first orientation to facilitate depositing the person on another support surface; and a seat frame comprising a pair of deployable arms, said sling frame being engageable with said sling when said sling is positioned on a planar support surface and operable to lift the sling off the planar surface, and said arms being deployable from a stowed position to a raised position for engaging said sling when supported by said sling support to provide lateral support to said sling.

11. The transport apparatus according to claim 10, wherein each of said deployable arms includes an upwardly projecting member for extending into a respective receptacle in said sling to thereby support said sling.

12. The transport apparatus according to claim 10, wherein said seat frame is operable to support said sling independent of said sling frame.

* * * * *